United States Patent [19]

Miura

[11] Patent Number: 4,768,912

[45] Date of Patent: Sep. 6, 1988

[54] PAPER ARRANGING APPARATUS

[76] Inventor: Isamu Miura, 16-6 Ryuusen, 3-Chome, Taitoh-ku, Tokyo, Japan

[21] Appl. No.: 116,184

[22] Filed: Nov. 3, 1987

Related U.S. Application Data

[63] Continuation-in-part of Ser. No. 901,675, Aug. 29, 1986, abandoned.

[30] Foreign Application Priority Data

Sep. 20, 1985 [JP] Japan ..... 60-208170

[51] Int. Cl.[4] ..... B65H 31/38

[52] U.S. Cl. ..... 414/32; 414/86; 414/114

[58] Field of Search ..... 414/32, 86, 114

[56] References Cited

U.S. PATENT DOCUMENTS

| | | | |
|---|---|---|---|
| 3,165,209 | 1/1965 | Sabasteanski | 414/32 |
| 3,249,242 | 5/1966 | Zachow | 414/32 |
| 4,117,771 | 10/1978 | Brinkmeier | 414/32 X |
| 4,585,225 | 4/1986 | Miura | 271/211 |

FOREIGN PATENT DOCUMENTS

| | | | |
|---|---|---|---|
| 2649959 | 5/1978 | Fed. Rep. of Germany | 414/114 |
| 2753668 | 6/1979 | Fed. Rep. of Germany | 414/114 |

*Primary Examiner*—Leslie J. Paperner

*Attorney, Agent, or Firm*—Schwartz & Weinrieb

[57] ABSTRACT

A paper arranging apparatus for unpiling a vertical stack of paper sheets disposed upon a paper feeding table and repiling the paper sheets into a vertical stack upon a paper piling table includes a vibrational transfer plate disposed within the vicinity of the upper region of the paper piling table, and a crossing plate pivotably mounted upon the upper end of the paper feeding table so as to be movable between a first inoperative elevated position, and a second lowered operative position which overlies the vibrational transfer plate. The crossing and vibrational transfer plates therefore bridge the lateral spacing defined between the paper feeding and paper piling tables in order to facilitate the paper transfer operation between the paper feeding and paper piling tables. The crossing plate has an arcuate configuration so as to cause smooth flowing of the paper sheets onto the vibrational transfer plate, and the vibrational transfer plate is caused to vertically reciprocate or vibrate so as to cause controlled feeding of the paper sheets onto the paper piling table. A resilient pressing arm associated with the vibrational transfer plate maintains the paper sheets in a properly arranged paper stack. The vibrational transfer plate is laterally adjustable relative to the paper stack upon the paper piling table, and the movement of the crossing plate to the inoperative position permits lateral movement of the transfer plate relative to the paper stack so as to facilitate removal of a completed stack from the paper piling table.

20 Claims, 2 Drawing Sheets

PAPER ARRANGING APPARATUS

CROSS-REFERENCE TO RELATED PATENT APPLICATIONS

The present patent application is a continuation-in-part of U.S. patent application Ser. No. 901,675 which was filed on Aug. 29, 1986, now abandoned.

FIELD OF THE INVENTION

The present invention relates generally to paper arranging apparatus, and more particularly to a paper arranging apparatus in which a paper feeding table for supporting a stack of papers to be unpiled, and a paper piling table for supporting a stack of papers to be repiled, are disposed in a side-by-side relationship with a predetermined spacing defined therebetween. In order to effectively bridge such predetermined spacing defined between the paper feeding and paper piling tables, and thereby facilitate the transfer of papers from the paper feeding table to the paper piling table, as well as to facilitate the properly arranged stacking of the papers upon the paper piling table, a vibrational plate is adjustably disposed within the vicinity of the upper end of the paper piling table, and a crossing plate is pivotably mounted upon the upper end of the paper feeding table so as to be movable between a first inoperative position and a second operative position at which the crossing plate cooperates with the vibrational plate in order to transfer the papers from the paper feeding table to the paper piling table.

BACKGROUND OF THE INVENTION

When printing operations upon paper have heretofore been performed by means of various different printing machines, it was necessary that the supply of paper supplied to the machines be performed in a precise manner and under identical, repetitive conditions with respect to the particular printing machine so that the printing operations could in fact be properly and accurately performed. In a similar manner, when papers of various different dimensions are desired to be cut to the same or identical dimensions, it is required that at least two sides or edges of each sheet of paper be identically arranged. These paper arranging processes, however, have heretofore been performed exclusively by means of manual labor, and consequently, as might be appreciated, such processes have been extremely difficult to perform, an inordinate amount of time was consumed, and the efficiency achieved was quite low whereby, in effect, uniform or accurate paper arranging of the paper sheets was virtually impossible to achieve.

In view of the foregoing, the present applicant has heretofore proposed a paper piling table which is capable of vertically stacking the sheets of paper in such a manner that the sheets of paper automatically have at least two side edges and an included corner uniformly arranged. This apparatus is disclosed within U.S. Pat. No. 4,585,225 which issued to Isamu Miura on Apr. 29, 1986. The operational efficiency of the stacking process was therefore considerably improved, however, serious drawbacks nevertheless remained in view of the fact that only a small stack of paper could be transferred at a single time from the paper feeding table to the paper piling table, and in addition, a large amount of manual labor was still required to be expended. Still yet further, the processing often resulted in some of the paper becoming jammed or crumpled. In addition, in view of the fact that the paper piling table of the noted patented arrangement was required to be disposed in a tilted mode so as to properly arrange at least one corner portion of each sheet of paper, the transportation or feeding of the paper sheets from the paper feeding table to the paper piling table could not be readily achieved in a smoothly operational manner.

OBJECT OF THE INVENTION

Accordingly, it is a primary objective of the present invention to provide a new and improved paper arranging apparatus which addresses and overcomes the aforenoted problems characteristic of the prior art, and wherein, in particular, the paper arranging apparatus can provide for the smooth and proper transportation of the paper sheets from the paper feeding table to the paper piling table without jamming or crumpling of the paper, and wherein further, the tilting and elevating modes of operation of the paper piling table are accommodated without any interference or obstruction.

SUMMARY OF THE INVENTION

The foregoing and other objectives are achieved in accordance with the present invention through the provision of a paper arranging apparatus which includes a paper feeding table upon which a vertical stack of paper sheets is originally disposed, a paper piling table laterally spaced from the paper feeding table and upon which the sheets of paper are to be vertically stacked after being transferred thereto from the paper feeding table, a vibrational plate mounted upon the paper piling table so as to be disposed within the vicinity of the upper end of the piling table, and a crossing plate pivotably mounted upon the upper end of the paper feeding table so as to be movable between a first inoperative, raised position at which the crossing plate permits unobstructed access to the vibrational plate and the stacked sheets of paper disposed upon the paper piling table, and a second operative, lowered position at which the crossing plate cooperates with the vibrational plate in order to facilitate the transfer of the paper sheets from the paper feeding table to the paper piling table. In particular, the crossing plate has an arcuate configuration which facilitates the movement and transfer of the paper sheets from the paper feeding table toward the vibrational plate of the paper piling table, and the disposition and positional angle of the crossing plate is controlled by means of a suitable drive device, such as, for example, a control motor.

Since the crossing plate is pivotably mounted upon the upper end of the paper feeding table, and since further, the dispositional angle of the crossing plate can be adjusted by means of the control motor, the paper feeding surface of the paper feeding table and the paper piling or receiving surface of the paper piling table can be properly linked or coupled together in order to facilitate the smooth transfer of the paper sheets from the paper feeding table to the paper piling table.

Still further, upon completion of the stacking of the paper sheets upon the paper piling table, the crossing plate may be pivoted upwardly by means of its control motor so as to be disposed at its elevated or raised inoperative position. At this position, the crossing plate is disposed remotely from the vibrational plate which may also be positionally adjusted such that both the vibrational plate and the crossing plate do not obstruct the vertical stack of paper sheets disposed upon the paper piling table whereby the vertical stack of paper sheets may be removed from the paper piling table so as to prepare the apparatus for a subsequent pape piling operation.

BRIEF DESCRIPTION OF THE DRAWINGS

Various other objects, features, and attendant advantages of the present invention will become more apparent from the following detailed description when considered in conjunction with the accompanying drawings, in which like reference characters designate like or corresponding parts throughout the several views, and wherein.

DETAILED DESCRIPTION OF THE PREFERRED EMBODIMENT

Figure 1:
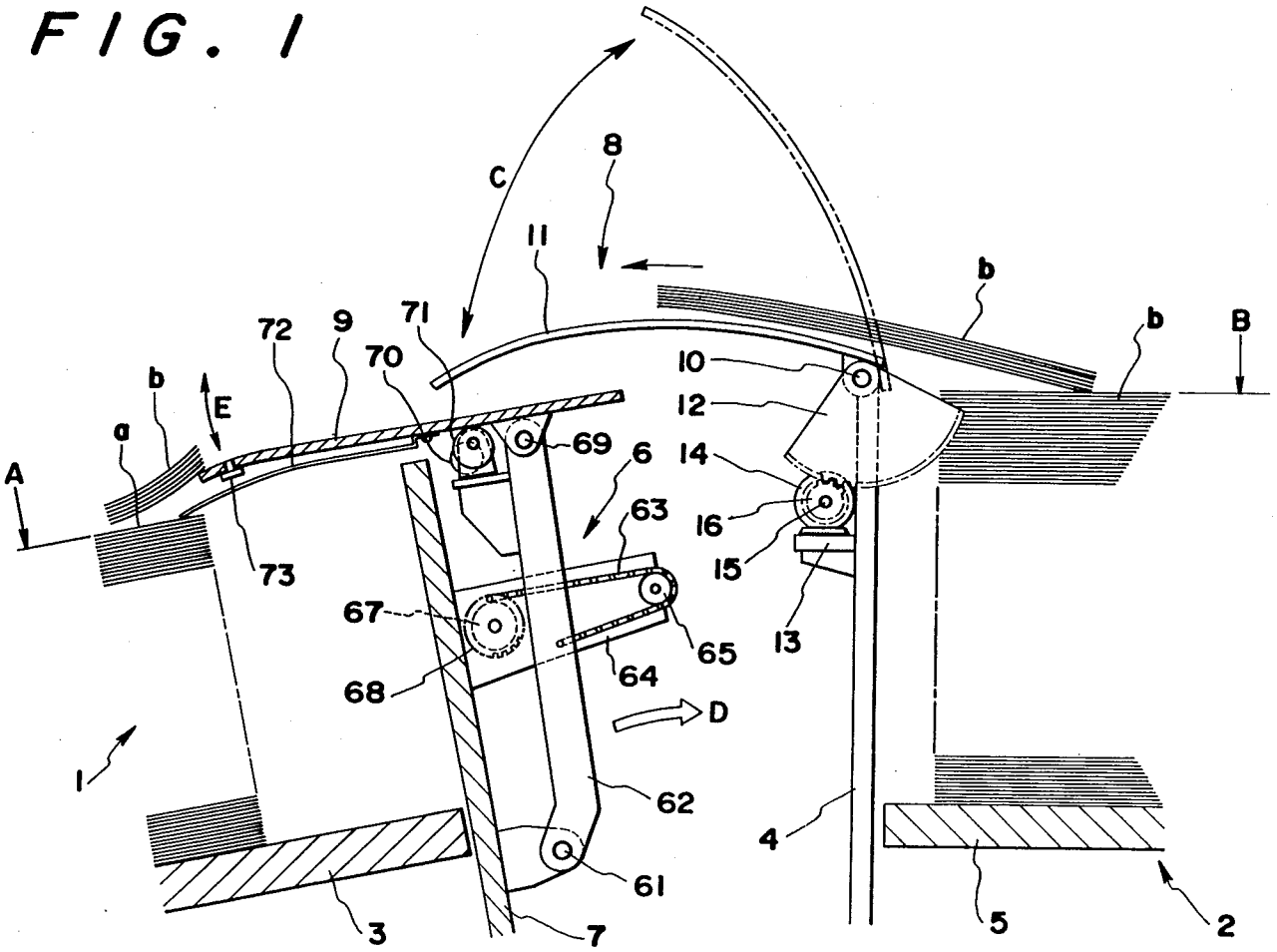
FIG. 1 is a vertical cross-sectional view of a preferred embodiment of the paper arranging apparatus constructed in accordance with the present invention.
Figure 2:
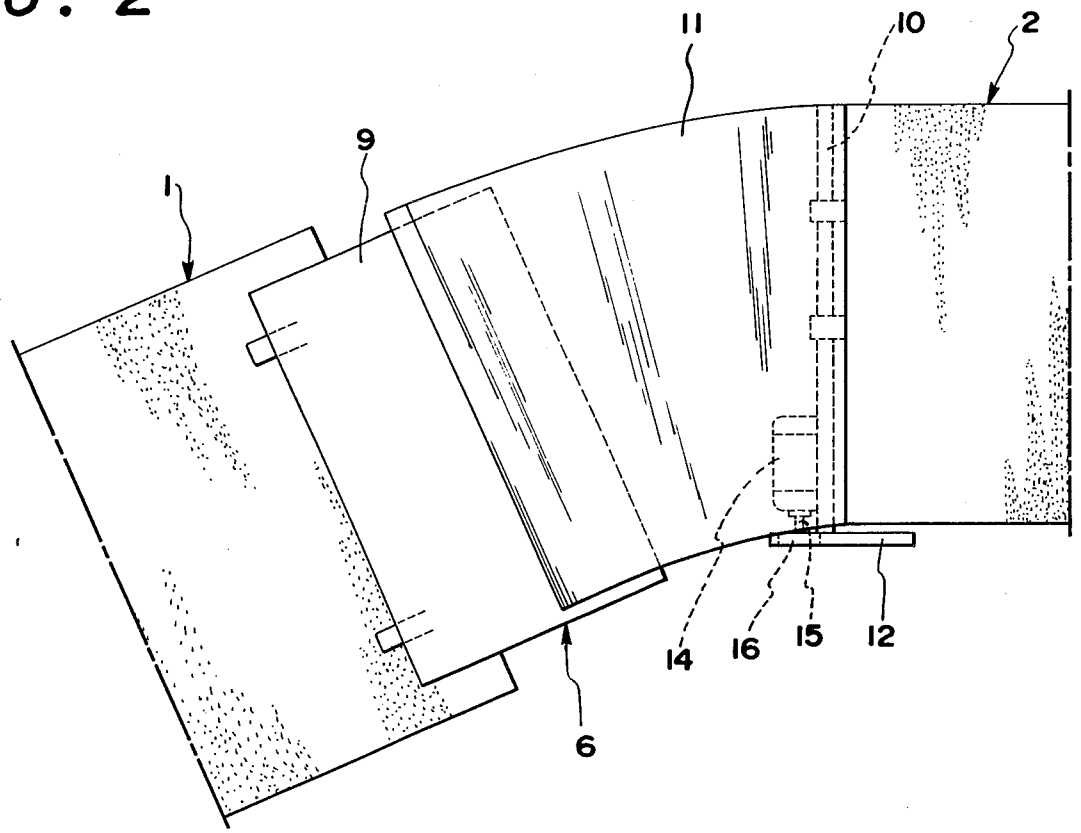
FIG. 2 is a plan view of the paper arranging apparatus of FIG. 1.

Referring now to the drawings, a preferred embodiment of a paper arranging apparatus or system constructed in accordance with the present invention will now be described. In particular, the apparatus of the present invention is seen to comprise a paper piling table 1 upon which a stack of paper sheets is to be vertically piled, and a paper feeding table 2, disposed adjacent to but laterally spaced from the paper piling table 1, upon which a vertically stacked pile of paper sheets is originally disposed and which is adapted to be unpiled and transferred to the paper piling table 1. During a paper arranging operation, the paper piling table 1 is disposed in a tilted orientation, by means of a suitable tilting mechanism, not shown, such that the side of the piling table 1 which is located furthest from the paper feeding table 2 is disposed at the lowermost position.

The paper piling table 1 includes a support table 3 which is vertically movable by a suitable means, not shown, such that the upper surface of the vertical stack of paper sheets a disposed upon support table 3 is always substantially located at a predetermined height or level A. Consequently, it is to be appreciated that at the beginning of the paper arranging or stacking operation, when paper sheets are beginning to be transferred from paper feeding table 2 to paper piling table 1, the support table 3 is disposed at its uppermost position, and as the paper arranging or stacking operation continues, the support table 3 is gradually lowered so as to accommodate the vertically increasing stack of paper sheets being transferred to and stacked upon support table 3. In a similar manner, the paper feeding table includes a support table 5 which is also vertically movable by a suitable means, also not shown, such that the upper surface of the vertical stack of paper sheets b disposed upon the support table 5 is always substantially located at a predetermined height or level B. Consequently, it is to be further appreciated that at the beginning of a paper arranging or stacking or piling operation, when paper sheets are beginning to be transferred from paper feeding table 2 to paper piling table 1, the support table 5 will be disposed at its lowermost or a lowered position in view of the fact that it will have disposed thereon a vertical stack of paper sheets to be unpiled, and as the paper unpiling and piling operation continues, the support table 5 is gradually elevated so as to always dispose the upper surface of the vertical stack of paper sheets at level B which thereby facilitates the transfer of the paper sheets from the paper feeding table 2 to the paper piling table 1.

As has been noted hereinbefore, the paper piling table 1 is laterally spaced from the paper feeding table 2, and in order to, in effect, bridge or span the lateral spacing defined between tables 1 and 2 in order to facilitate and achieve the paper transfer operation from paper feeding table 2 to paper piling table 1, paper piling table 1 has a vibrational transfer plate 9 disposed within the vicinity of the upper level or end thereof, while paper feeding table 2 has a crossing plate 11 pivotably mounted upon the upper end of a vertically extending sidewall 4 which forms part of the supporting framework for the paper feeding table 2. The crossing plate 11 has an arcuate configuration and is pivotably mounted upon sidewall 4 by means of a shaft 10 so as to be movable within an angular range denoted by the arrow C between a first, elevated or raised inoperative position shown in dotted lines, and a second, lowered operative position shown in solid lines whereby, when the crossing plate 11 is disposed in its lowered, operative position, it operationally cooperates with the vibrational transfer plate 9 by partially overlapping the same. The pivotal movement of the crossing plate 11 is controlled by means of a fanshaped sector gear 12 which is also fixedly attached to the pivotal shaft 10, and a toothed gear 16 which is enmeshed with sector gear 12, toothed gear 16 being fixedly mounted upon a drive shaft 15 of a suitable control motor drive 14. The motor 14 may be a stepping type motor and is mounted upon a bracket 13 which is fixedly secured to the exterior surface of the paper feeding table framework sidewall 4. The entire crossing plate system, including crossing plate 11, sector gear 12, and the motor drive 14, is generally designated by the reference character 8.

Continuing further, and in a similar manner, the vibrational transfer plate system, including vibrational transfer plate 9, is generally indicated by the reference character 6 and is seen to include a substantially vertically extending support arm 62 which is pivotably mounted at its lower end upon a vertically extending sidewall 7, which forms part of the supporting framework for the paper piling table 1, through means of a pivot pin or shaft 61 and a suitable bracket, not numbered. The vibrational transfer plate 9 is pivotably secured to the upper end of the arm 62 by means of another pivot pin or shaft 69, and a bracket 64 is fixedly secured to the exterior surface of framework sidewall 7 so as to extend horizontally or laterally outwardly therefrom. A control motor 67 is fixedly mounted upon bracket 64 and has a chain gear 68 operatively associated therewith. A second chain gear or pulley 65 is fixedly mounted upon the opposite end of bracket 64, and the gears 68 and 65 are interconnected together by means of an endless chain 63. Chain 63 also has an intermediate portion thereof affixed to arm 62. In this manner, in response to the forward or reverse drive of control motor 67, chain drive 63, and therefore support arm 62 which is fixedly attached thereto, can be adjustably positioned in the lateral direction, as denoted by the arrow D, so as to in effect laterally adjust the disposition of the vibrational transfer plate 9 relative to the stack of paper sheets a disposed upon the paper piling table 1, and more particularly the support table 3 thereof. The importance of such lateral adjustment is apparent when it is further appreciated that a resilient pressing arm 72, which may take the form, for example, of a leaf-type spring, is fixedly secured to the undersurface of vibrational transfer plate 9, and it is seen from FIG. 1 that the distal or free end of the pressing arm 72 is adapted to be disposed in pressure contact with the proximal or closest end or edge portion of the stack of paper sheets a supported upon paper piling support table 3. In this manner, the sheets a are lightly clamped upon the support table 3 so as to retain the same in their stacked and properly arranged position without permitting the paper sheets to become disarranged, crumpled, or the like. The particular lateral adjustment of the vibrational transfer plate 9 and the pressing arm 72 thereof will of course be determined by the length of the paper sheets a being stacked upon the support table 3 so that the free end of pressing arm 72 is always in contact with only the edge portion of the paper sheets a. The significance of this structural and operational interrelationship will likewise become more apparent hereinafter.

A second control motor 70 is fixedly mounted upon the upper end of vibrational transfer plate support arm 62 through means of a suitable bracket, not numbered, and an eccentric cam 71 is operatively associated with second control motor 70. The peripheral surface of eccentric cam 71 is disposed in contact with the undersurface of vibrational transfer plate 9, and consequently, it may readily be appreciated that as the control motor 70 rotates eccentric cam 71, the latter causes the vibrational transfer plate 9 to rapidly vibrate in a vertically reciprocating mode as schematically indicated by the reference character arrow E. A sensor or detector 73 is fixedly disposed within the distal or free end portion of the vibrational transfer plate 9, and the same is adapted to or capable of detecting or sensing the presence of a paper sheet disposed upon or passing over the vibrational transfer plate 9. Detector or sensor 73 may, for example, comprise a photodetector, and when the same in fact senses or detects the presence of a sheet of paper disposed upon vibrational transfer plate 9 and passing thereover or therealong, an electrical signal is conducted to second control motor 70 in order to drive the same and cause rotation of the associated eccentric cam 71 whereupon vibration of the vibrational transfer plate 9 is achieved. Such vibrational movement of the vibrational transfer plate 9 causes the paper sheets b originally deposited upon the crossing plate 11 and the end or portion of vibrational transfer plate 9 which is disposed near crossing plate 11 to be longitudinally moved across vibrational transfer plate 9 so as to be deposited or piled upon paper piling support table 3 so as to thereby form piled paper stack a. As the paper sheets b are discharged from the free end of the vibrational transfer plate 9 and onto paper piling support table 3 so as to form paper stack a, the free end of pressing arm or spring 72 will, in effect, reciprocate vertically across each sheet edge and when the sheet edge is disposed beneath the free end of the pressing arm or spring 72, the sheet will be retained upon the paper stack a. As noted, therefore, hereinabove, the lateral disposition of the vibrational transfer plate 9 and its associated pressing arm or spring 72 is therefore important so as to properly achieve the discharge of the paper sheets b from the free end of the vibrational transfer plate 9 while subsequently retaining the paper sheets properly arranged or stacked within the pile a. It is to be appreciated that if the vibrational transfer plate 9 and the associated pressing arm or spring 72 were disposed too far toward the right, as viewed in FIG. 1, such that the free end of the pressing arm or spring 72 were not at all in contact with the stacked paper sheets a, then the clamping and retaining function thereof would, in effect, be completely defeated. On the other hand, if the vibrational transfer plate 9 and its associated pressing arm or spring 72 were disposed too far toward the left, as viewed in FIG. 1, then the selective release of each paper sheet b from the free end of pressing arm or spring 72 and vibrational transfer plate 9 could not be achieved whereby the trailing ends of the paper sheets b would remain atop the vibrational transfer arm 9 and the pressing arm or spring 72 whereby such trailing ends of the paper sheets b would not be able to be properly retained or clamped upon the paper stack a.

The operation of the apparatus of the present invention is believed to be apparent from the foregoing description, however, a brief description of an operative mode of the apparatus of the present invention will now be provided. In preparing for the performance of a paper unpiling, transfer, and repiling operation of a stack of paper sheets b from the paper feeding table 2 to the paper piling table 1, the control motor 14 is initially actuated so as to cause toothed gear 16 and sector gear 12 to rotate in such as manner that the crossing plate 11 is moved from its solid line, lowered operative position to its dotted line, elevated inoperative position. When the crossing plate 11 is disposed in its latter position, free access to the vibrational transfer plate 9 is permitted whereby lateral adjustment of the disposition of vibrational transfer plate 9, and its associated pressing arm or spring 72, can be achieved, by means of motor drive 67 and support arm 62, so as to properly position vibrational transfer plate 9 and pressing arm 72 dependent upon the size of the particular paper sheets b being transferred from paper feeding table 2 to paper piling table 1. Subsequent to the such adjustment step for vibrational transfer plate 9 and pressing arm 72, control motor 14 is again actuated in the reverse direction so as to reversely drive toothed gear 16 and sector gear 12 whereby the crossing plate 11 is moved from its elevated inoperative position to its lowered operative position at which the crossing plate 11 is disposed at a vertically spaced location with respect to the upper surface of vibrational transfer plate 9. This vertical spacing is specifically determined so as to permit the smooth transfer of the paper sheets b from the crossing plate 11 onto the vibrational transfer plate 9 while nevertheless permitting or accommodating the vibrational movement of transfer plate 9 throughout its vibrational movement amplitude as determined by rotary eccentric cam 71. In achieving the actual transfer of paper sheets from the paper feeding table 2 to the paper piling table 1, an operator will initially remove a small stack of sheets b from the entire stack of paper sheets b and deposit the same upon the crossing plate 11 which is now disposed in its lowered operative position, all as shown in FIG. 1. The arcuate configuration of the crossing plate 11 causes the paper sheets to, in effect, flow downwardly toward and onto vibrational transfer plate 9 and onwardly toward the paper piling table 1 so as to ultimately form repiled paper stack a. The paper piling support table 3 is at this time disposed in its elevated position, since this is the beginning of the paper piling operation, and as the sheets of paper are detected to be present upon vibrational transfer plate 9 by means of detector or sensor 73, motor drive 70 is actuated so as to cause rotation of eccentric cam 71 and thereby vibration of the transfer plate 9 in order to vibrationally feed the paper sheets from transfer plate 9 onto support table 3 of the paper piling table 1. As the unpiling and piling process continues, the support tables 5 and 3 will be respectively elevated and lowered so as to effectively maintain the paper levels essentially constant at the designated levels or heights B and A, respectively, and upon completion of the repiling operation, crossing plate 11 will be raised to its inoperative position so as not to interfere with movement of the vibrational transfer plate 9, the latter can be laterally moved toward the right, as viewed in FIG. 1, if necessary, so as to remove the free end of the pressing arm 72 from the paper sheet stack a, and consequently, the complete paper stack a can be removed from the paper piling support table 3 so as to permit another paper piling operation to be performed.

Thus it may be seen that the present invention embodies important advances over the prior art in that the trasnfer operation of the paper sheets from the paper feeding table to the paper piling table can be assuredly achieved in a smooth-flowing manner, and in addition, whereby the proper stacking, arranging, and maintenance of the repiled and stacked papers is able to be accomplished without shifting of the stacked paper sheets, jamming of the same, crumpling or tearing thereof, and the like. In addition, the operator is relieved from the arduous and cumbersome task of transferring the paper sheets directly from the paper feeding table to the paper piling table.

Obviously, many modifications and variations of the present invention are possible in light of the above teachings. For example, while the rotary drive means for controlling the disposition of the crossing plate 11 has been illustrated as comprising the toothed gear 16 and sector gear 12, other rotary drive mechanisms or systems can of course be utilized. It is therefore to be further understood that in accordance with the scope of the appended claims, the present invention may be practiced otherwise than as specifically described herein.

What is claimed as new and desired to be protected by means of Letters Patent of the United States of America, is:

1. A paper arranging apparatus, comprising:
a paper piling table for supporting a stack of paper to be piled thereon;
a paper feeding table, spaced from said paper piling table, for supporting a stack of paper to be unpiled therefrom and transferred to said paper piling table for piling thereon;
a crossing plate pivotably mounted upon said paper feeding table between a first inoperative position and a second operative position at which said crossing plate substantially spans the space defined between said paper feeding table and said paper piling table so as to facilitate the transfer of said paper from said paper feeding table to said paper piling table; and
vibrational plate means mounted upon said paper piling table for receiving said paper from said paper feeding table and said crossing plate and for depositing said paper, received from said paper feeding table and said crossing plate, onto said paper piling table so as to form a properly arranged stack of paper upon said paper piling table.

2. Apparatus as set forth in claim 1, wherein:
said crossing plate has an arcuate configuration with the concave portion thereof disposed downwardly.

3. Apparatus as set forth in claim 1, wherein:
said first inoperative position of said crossing plate is an elevated position, and said second operative position of said crossing plate is a lowered position at which said crossing plate partially overlies said vibrational plate means.

4. Apparatus as set forth in claim 1, wherein:
said crossing plate is pivotably mounted upon an upper end portion of said paper feeding table.

5. Apparatus as set forth in claim 1, further comprising:
means mounted upon said paper feeding table for moving said crossing plate between said first inoperative and second operative positions.

6. Apparatus as set forth in claim 5, wherein said moving means comprises:
a drive motor;
a toothed gear fixedly mounted upon a drive shaft of said drive motor; and
a sector gear fixedly attached to said crossing plate and enmeshed with said toothed gear.

7. Apparatus as set forth in claim 1, wherein:
said vibrational plate means is mounted upon said paper piling table so as to be disposed within the vicinity of the upper end of said paper piling table.

8. Apparatus as set forth in claim 1, further comprising:
means mounting said vibrational plate means upon said paper piling table for laterally adjusting the disposition of said vibrational plate means relative to said paper piling table.

9. Apparatus as set forth in claim 8, wherein said mounting means comprises:
a support arm having one end thereof pivotably mounted upon said paper piling table and the other end thereof attached to said vibrational plate means; and
drive means mounted upon said paper piling table and connected to an intermediate portion of said support arm for moving said support arm in a lateral direction within a predetermined range of movement.

10. Apparatus as set forth in claim 1, wherein said vibrational plate means comprises:
a vibrational transfer plate;
a drive motor mounted upon said paper piling table; and
cam means operatively driven by said drive motor and engaged with said vibrational transfer plate for imparting reciprocating vibrational movements to said vibrational transfer plate as a result of drive movements imparted to said cam means by said drive motor.

11. Apparatus as set forth in claim 10, further comprising:
detector means for detecting the presence of paper sheets upon said vibrational transfer plate and for activating said drive motor in response to detection of the presence of said paper sheets upon said vibrational transfer plate.

12. Apparatus as set forth in claim 1, further comprising:
resilient pressing means mounted upon said vibrational plate means for engaging the upper surface of said stack of paper disposed upon said paper piling table so as to retain the paper sheets forming said stack of paper upon said paper piling table in a properly arranged stack of paper.

13. Apparatus as set forth in claim 12, wherein:

said pressing means comprises a leaf-spring type arm secured to the undersurface of said vibrational plate means.

14. Apparatus as set forth in claim 1, wherein:

said paper feeding table comprises a vertically movable support table for supporting said stack of paper to be unpiled, said support table being movable between a lowered position for supporting a new stack of paper at the beginning of a paper transfer operation, and an elevated position for supporting a depleted stack of paper near the end of said paper transfer operation, whereby the upper surface of said stack of paper disposed upon said paper feeding table remains essentially constant at a predetermined height level.

15. Apparatus as set forth in claim 1, wherein:

said paper piling table comprises a vertically movable support table for supporting said stack of paper being piled thereon, said support table being movable between a vertically elevated position for supporting sheets of paper transferred to said support table at the commencement of a paper transfer operation, and a lowered position for supporting an increasing stack of paper near the end of said paper transfer operation, whereby the upper surface of said stack of paper disposed upon said paper piling table remains essentially constant at a predetermined height level.

16. Apparatus as set forth in claim 10, further comprising:

a support arm mounted upon said paper piling table; and said drive motor is fixedly mounted upon said support arm.

17. Apparatus as set forth in claim 10, wherein:

said cam means is a rotary driven eccentric cam mounted upon a drive shaft of said drive motor.

18. Apparatus as set forth in claim 11, wherein:

said detector is a photodetector.

19. Apparatus as set forth in claim 9, wherein said drive means comprises:

a drive motor;

a first toothed pulley rotatably driven by said drive motor;

a second toothed pulley located remote from said first toothed pulley; and a drive chain interconnecting said first and second toothed pulleys and connected to said support arm

20. Apparatus as set forth in claim 1, wherein:

said paper piling table is inclined with respect to a horizontal plane so as to facilitate the proper uniform arrangement of said sheets of paper forming said piled stack of paper supported thereon.

* * * * *